US007753060B2

(12) United States Patent
Kozy et al.

(10) Patent No.: US 7,753,060 B2
(45) Date of Patent: Jul. 13, 2010

(54) CELLULAR AQUEOUS TUBE CLEANING SYSTEM AND METHOD

(75) Inventors: David M. Kozy, Kent, WA (US); Daniel L. Nydegger, Auburn, WA (US); Kin Y. Wong, Renton, WA (US); William R. Schell, Federal Way, WA (US); David L. Wagner, Goldendale, WA (US)

(73) Assignee: The Boeing Company, Chicago, IL (US)

( * ) Notice: Subject to any disclaimer, the term of this patent is extended or adjusted under 35 U.S.C. 154(b) by 1236 days.

(21) Appl. No.: 11/317,336

(22) Filed: Dec. 22, 2005

(65) Prior Publication Data

US 2007/0074744 A1 Apr. 5, 2007

Related U.S. Application Data

(60) Provisional application No. 60/723,218, filed on Oct. 3, 2005.

(51) Int. Cl.
*B08B 9/02* (2006.01)
*B08B 9/00* (2006.01)
*B08B 3/00* (2006.01)

(52) U.S. Cl. ..... 134/137; 134/104.2; 134/155; 134/166 C; 134/166 R; 134/167 C; 134/168 C; 134/169 C

(58) Field of Classification Search ..... 134/22.1, 134/33, 137, 149, 155, 166 C, 166 R, 169 C, 134/184, 8, 22.11, 22.12, 62, 84, 104.2, 135, 134/168 R, 167 C, 168 C, 169 R, 170, 171
See application file for complete search history.

(56) References Cited

U.S. PATENT DOCUMENTS

| | | | | | |
|---|---|---|---|---|---|
| 2,319,531 | A * | 5/1943 | Brown et al. | 134/166 R |
| 2,685,293 | A * | 8/1954 | Elm et al. | 134/153 |
| 2,857,922 | A * | 10/1958 | Effinger | 134/133 |
| 3,060,064 | A * | 10/1962 | Zingg | 134/2 |
| 3,225,777 | A * | 12/1965 | Shelton et al. | 134/141 |
| 3,490,468 | A * | 1/1970 | Di Donato | 134/22.11 |
| 4,526,020 | A * | 7/1985 | Fey et al. | 68/3 R |
| 4,534,188 | A * | 8/1985 | Fey | 68/3 R |
| 4,535,610 | A * | 8/1985 | Fey et al. | 68/3 R |
| 4,763,678 | A * | 8/1988 | Ott | 134/171 |
| 5,103,847 | A * | 4/1992 | Martin et al. | 134/157 |
| 5,549,759 | A * | 8/1996 | Lithander | 134/22.11 |
| 5,870,906 | A * | 2/1999 | Denisar | 68/17 R |
| 2002/0133886 | A1 * | 9/2002 | Severns et al. | 8/142 |
| 2006/0169302 | A1 * | 8/2006 | Kozy et al. | 134/18 |
| 2006/0185691 | A1 * | 8/2006 | Joseph | 134/22.1 |

* cited by examiner

*Primary Examiner*—Joseph L Perrin
*Assistant Examiner*—Benjamin Osterhout

(57) ABSTRACT

An aqueous tube cleaning system as described herein can be utilized to clean a plurality of tubes having different lengths. The system includes a tower assembly having a wash chamber that houses the tubes during the cleaning cycle. The tower assembly is held in a horizontal load/unload position for loading and unloading of the tubes. The system rotates the tower assembly into a vertical cleaning orientation to accommodate cleaning with cleaning and rinse solutions, which flow through and around the tubes using the force of gravity. After rinsing and draining, the tower assembly is rotated back to the horizontal position for unloading.

18 Claims, 9 Drawing Sheets

CELLULAR AQUEOUS TUBE CLEANING SYSTEM AND METHOD

RELATED APPLICATION

This application claims the benefit of U.S. provisional patent application Ser. No. 60/723,218, filed Oct. 3, 2005.

TECHNICAL FIELD

The present invention relates generally to industrial parts washers. More particularly, the present invention relates to aqueous tube cleaning systems and methods.

BACKGROUND

During manufacturing, machine parts often must be cleaned to remove metal chips, lubricating oils and contaminants before being installed in an assembly or being delivered. In addition, used parts often must be cleaned during overhaul or maintenance operations. As a result, a wide variety of methods and devices have been developed to cleanse parts. Industrial parts washers may be developed for general use or for specific applications. Industrial parts washers are utilized in a wide variety of industries; for example, extensive use is found in the automotive industry, the aerospace industry, the agricultural equipment industry, the heavy equipment industry, and the computer industry. Furthermore, industrial parts washers have been developed to remove a wide variety of contaminants, including, for example, carbon residue, grease, grinding compounds, oils, lubricants, metal burrs, metal working fluids, mold release, particulates, rust, soil, and wax.

Depending on the application, industrial parts washers have been designed using an assortment of cleaning methods. For example, immersion cleaning equipment typically is outfitted with baskets or screened trays to handle parts that cannot tolerate rotation or tumbling. Spray washers, or pressure parts washers, clean parts by directing a pressurized spray of hot water or cleaning solution at a component. Immersion parts washers clean components by submerging them in an agitated cleaning solution contained in a wash tank. Solvent washers use chemical solvents to clean or degrease, typically immersing parts in a liquid solvent or utilizing spray nozzles to disperse the solvent for additional cleaning. Ultra-sonic cleaning systems use vibration developed by uniformly dispersing ultrasonic cavitation into a fluid surrounding the parts or components. Forced-flow systems channel pressurized fluid through a cavity in the parts, such as tubing.

Industrial washers also come in a wide range of sizes, from small table-top washing machines or small scrub tank sinks to large front-loading turntable or conveyor cleaning systems. These systems may be designed for general cleaning or for highly specialized applications, such as critical cleaning systems of electronics components or wafers, bottle or container cleaners, or sterilizing and disinfecting cleaners for pharmaceutical and food applications. Included among these specialized applications of specific industrial parts washers are tube cleaning systems.

Tube cleaning systems apply various methods to deliver a cleaning solution to each tube. For example, some tube cleaning systems utilize flexible hose connections, inserting an individual hose into each tube to ensure delivery of cleaning solution to each tube. However, this requires significant labor, because each tube must be individually fitted to a hose connector. Furthermore, the tube sizes that can be cleaned are limited by the size of the hose connectors. In addition, some tube cleaning systems use solvents that require special handling and disposal. Other tube cleaning systems require excessively high fluid flow rates to clean large tubes. Moreover, many tube cleaning systems are designed for large batch processes, and cannot be adapted for use in an efficient cellular manufacturing scheme.

Despite the number and variety of industrial cleaning systems available, specific applications continue to require the development of new industrial parts washers. Accordingly, it is desirable to provide a method and system that uses an aqueous cleaning solution to clean tubing of a range of diameters, capable of accommodating small diameter and large diameter tubes of various lengths simultaneously without requiring that the individual tubes be held in place by individual fixtures. It is also desirable that the method and system be capable of cleaning large diameter tubing without requiring excessive fluid flow rates. Furthermore, it is desirable that the cleaning system be suitable for use in an efficient cellular manufacturing scheme.

BRIEF DESCRIPTION OF THE DRAWINGS

A more complete understanding of the present invention may be derived by referring to the detailed description and claims when considered in conjunction with the following figures, wherein like reference numbers refer to similar elements throughout the figures.

DETAILED DESCRIPTION

Figure 1:
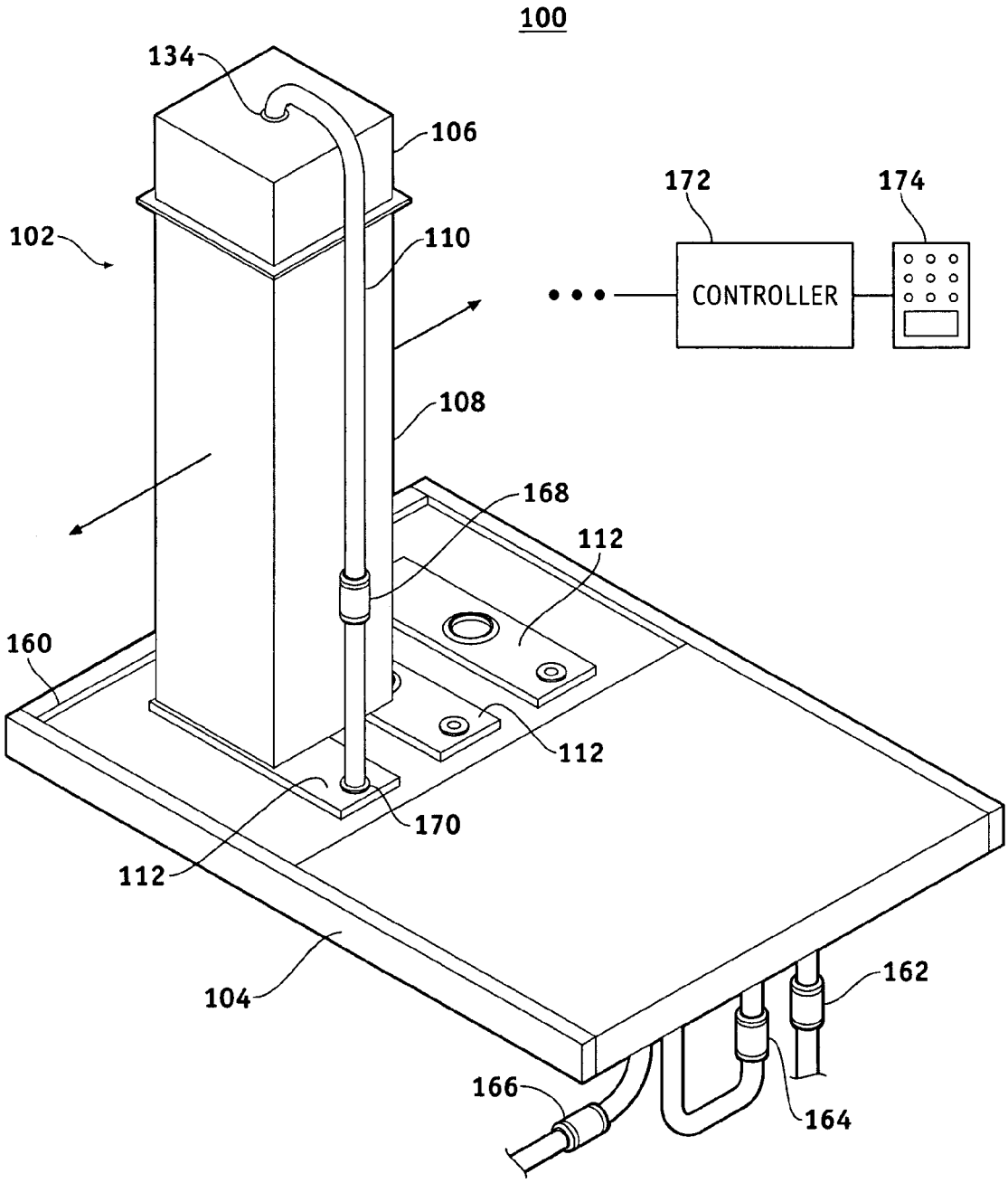
FIG. 1 is a perspective view of a tube cleaning system configured in accordance with an example embodiment of the invention.

The following detailed description is merely illustrative in nature and is not intended to limit the invention or the application and uses of the invention. Furthermore, there is no intention to be bound by any expressed or implied theory presented in the preceding technical field, background, brief summary or the following detailed description.

Existing tube cleaning systems include immersion systems, spray systems, ultrasonic systems, and forced flow systems. Such systems include totally enclosed recirculating type systems as well as multiple open tank (wash-rinse-rinse) systems. Various methods are also used to deliver or ensure the delivery of aqueous cleaning solution to each tube. These methods include flexible hose connections and hoses inserted into each tube to deliver cleaning solution to each tube.

Currently available aqueous cleaning systems do not lend themselves to compact, dedicated cleaning of tubes with a relatively large range in diameters and tube lengths. Connecting a cleaning system to the tubes can be very labor intensive. Previous approaches required that the tubes be individually attached to a cleaning head in order to ensure that the interior of the tube is adequately cleaned.

Tubes manufactured for use on aircraft must be cleaned prior to use. One practical manufacturing plan calls for a tube cleaning process that is: an aqueous (i.e., water-based) cleaning system; located in the cells where the tubes are fabricated (i.e., no batch processing); compact in size; self contained; portable; quiet; easy to load and unload with parts; and easy and simple to operate. In addition, the example tube cleaning process: provides forced flow for all tube diameters ensuring effective cleaning; is capable of cleaning very short and very long tubes simultaneously; can flexibly handle tubes ranging in size up to 13 feet in length and having a range in diameters from ⅜ inch to 2.5 inches simultaneously; does not require fixturing or connecting to individual tubes; is able to effectively clean several bundles of tubes simultaneously (e.g., 6-8 tubes per typical bundle); has a high cleaning capacity (e.g., 1200-1500 tubes per day); is able to clean up to 100 tubes per load, depending on tube diameter; and has a short cleaning cycle time of approximately 15-20 minutes per load.

A system according to the invention allows tubes of an extremely wide range of diameters and lengths to be cleaned at the same time. The system utilizes a cleaning concept that accommodates small diameter and large diameter tubes simultaneously without individually fixturing the tubes. The system cleans using an automatic wash-rinse-rinse cycle. In practice, the cleaning system is compact and portable, simple to operate, and capable of use in a lean manufacturing cellular system. The cleaning system eliminates environmentally unfriendly solvent-based cleaning and the associated VOC emissions issues. Moreover, the cleaning system greatly improves part flow through the shop, reducing flow time.

In one practical embodiment, the tube cleaning system is configured as a Type II system, where relatively long tubes are inserted horizontally, and once in the apparatus, the apparatus is rotated into a vertical position to utilize the high-low flow. The horizontal load is desirable for longer Type II tubes (in contrast to the relatively shorter Type I tubes). The example Type II system is capable of cleaning a wider variety of tubes in much larger quantities (and is especially useful for the very long tubes).

Figure 2:
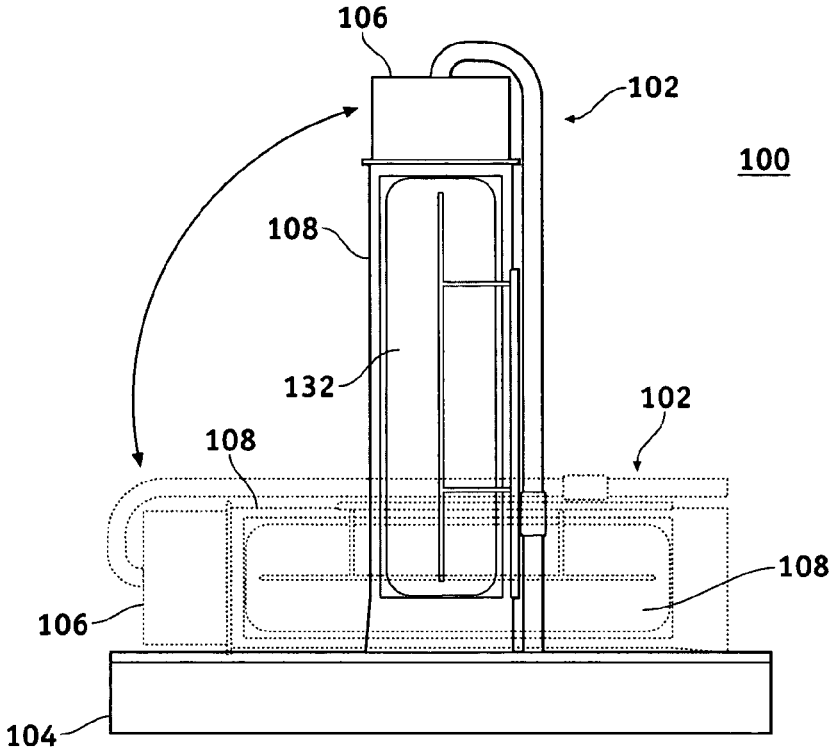
FIG. 2 is a front view of the tube cleaning system, depicting a load/unload orientation and a cleaning orientation of a tower assembly.
Figure 3:
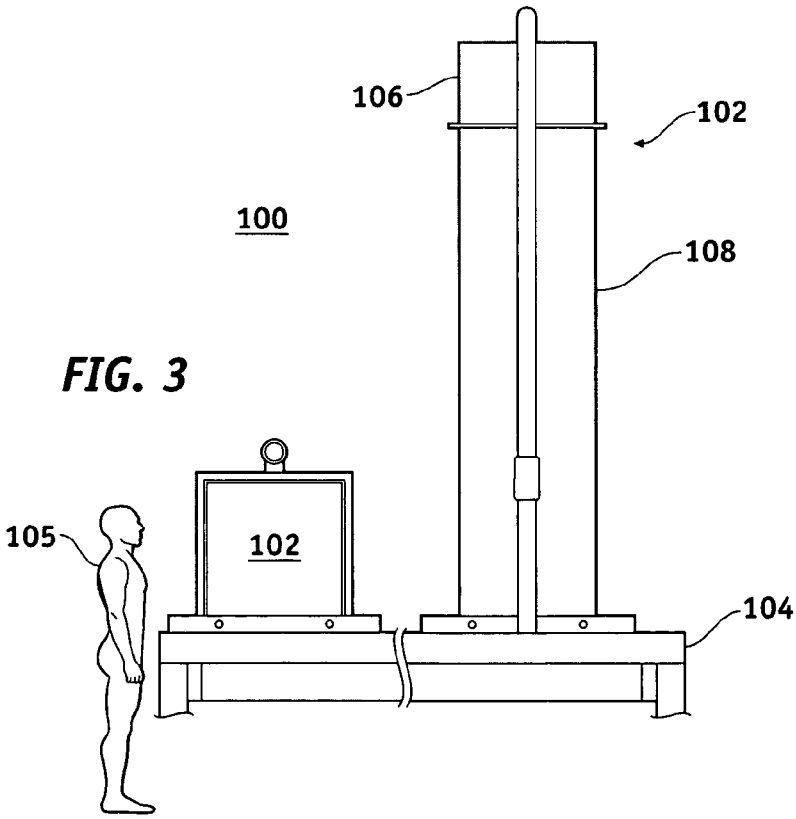
FIG. 3 is a side view of the tube cleaning system, depicting a load/unload position and a cleaning position for the tower assembly.

An example embodiment of the invention will now be described with reference to FIG. 1, which is a perspective view of a tube cleaning system 100 configured in accordance with an example embodiment of the invention. System 100 generally includes a tower assembly 102 and a support platform 104. The tower assembly 102 is coupled to the support platform 104 in a manner that allows the tower assembly 102 to rotate from a horizontal load/unload orientation to a vertical washing/cleaning orientation on the support platform 104. System 100 is also configured to move tower assembly 102 from a horizontal load/unload position located near the front of system 100 to a horizontal position located near the rear of system 100. This allows a door (not shown in FIG. 1) on tower assembly 102 to be safely opened and closed outside the reach of the operator. This also allows system 100 to safely rotate tower assembly 102 outside the reach of the operator. FIG. 2 is a front view of the tube cleaning system 100, depicting the tower assembly 102 in its load/unload orientation (horizontal), and in its cleaning orientation (vertical). FIG. 3 is a side view of the tube cleaning system 100, depicting the load/unload position for tower assembly 102, and a vertical cleaning position for tower assembly 102. As shown in FIG. 3, the load/unload position corresponds to a placement of tower assembly 102 near to an operator 105.

In this example, the tower assembly 102 includes a top tank 106, a wash chamber 108 coupled to the top tank 106, and one or more fluid conduits (e.g., a feed tube) 110 for carrying cleaning and rinsing solution. A number of solution receptacles 112 can be coupled to the support platform 104 as described below. In a preferred embodiment, the wash chamber 108 and top tank 106 are constructed of welded polypropylene plastic.

Figure 4A:
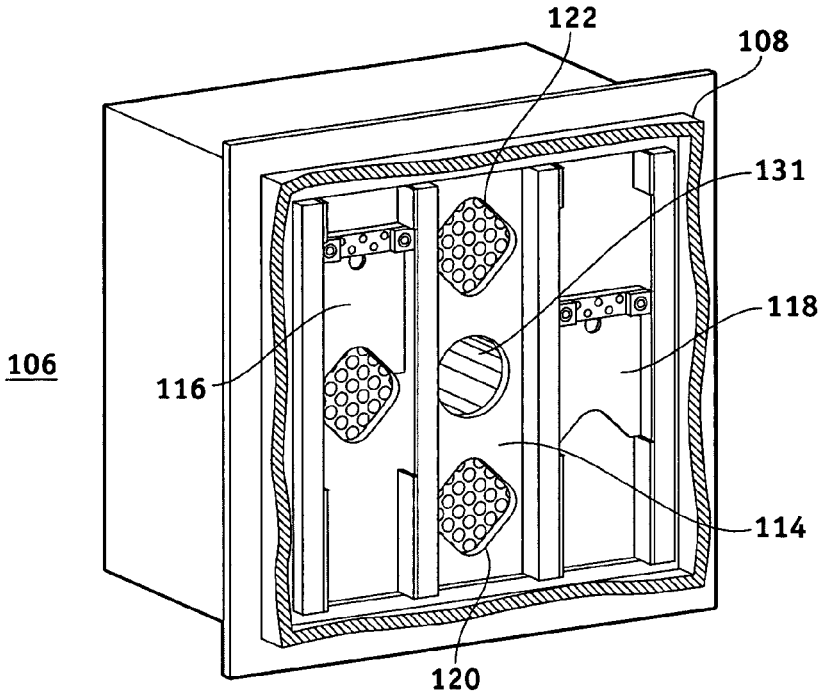
FIG. 4A is a perspective view of the interior of the wash chamber utilized by the tube cleaning system.

In operation, tubes are loaded into the wash chamber 108 such that the tube ends protrude through a holding plate and into the top tank 106. The tubes are clamped or held in place via a suitable holding mechanism or technique. In this regard, FIG. 4A is a perspective view of the interior of the wash chamber 108 utilized by the tube cleaning system 100. FIG. 4A depicts the holding plate 114, which separates top tank 106 from wash chamber 108. In this example, holding plate 114 includes four tube clamp assemblies. Tube clamp assembly 116 is depicted in the open position, tube clamp assembly 118 is depicted in the closed position, and holding plate 114 includes two additional tube clamp assemblies 120/122.

Figure 5:
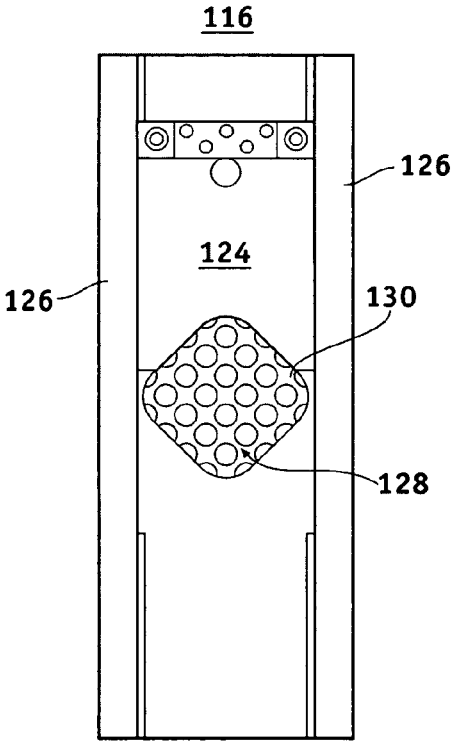
FIG. 5 is a plan view of a tube clamp assembly (in the open position) utilized by the tube cleaning system.
Figure 6:
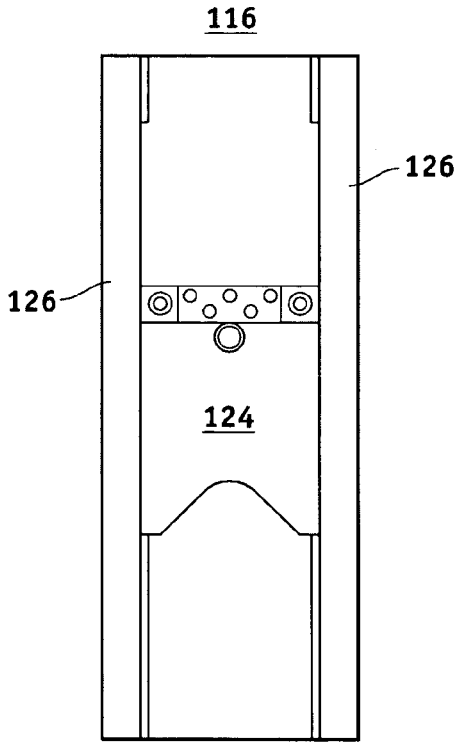
FIG. 6 is a plan view of the tube clamp assembly in the closed position.
Figure 4B:
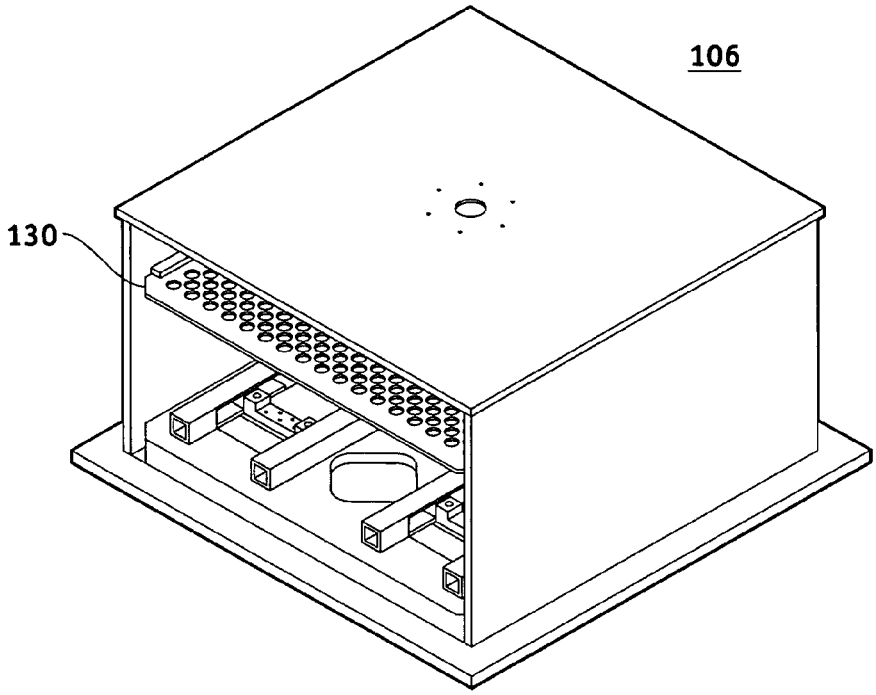
FIG. 4B is a perspective view showing the interior of the top tank.
Figure 4C:
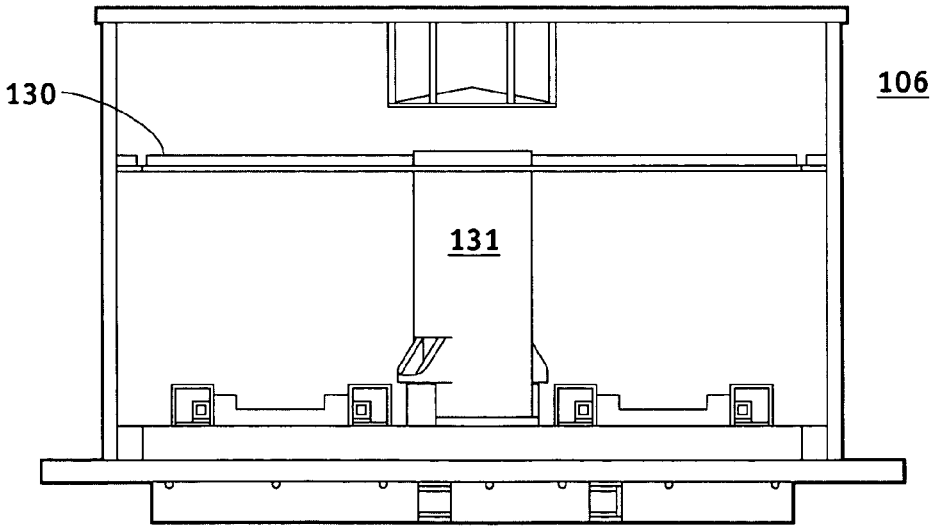
FIG. 4C is a side view of the top tank, with the front panel removed.

FIG. 5 is a plan view of a tube clamp assembly (such as tube clamp assembly 116) in the open position, and FIG. 6 is a plan view of tube clamp assembly 116 in the closed position. Tube clamp assembly 116 includes a clamp plate 124 that slides within a track or rail system 126 to reduce or increase the size of an opening 128 that is configured to receive the tubes. Tube clamp assembly 116 may be pneumatically operated with air cylinders that cause clamp plate 124 to bear upon the tubes inserted within opening 128. As depicted in FIG. 5, tube clamp assembly 116 may include a perforated barrier plate 130 that is mounted inside top tank 106. Barrier plate 130 includes a number of holes formed therein for fluid passage. Barrier plate 130 prevents tubes from being inserted into top tank 106 farther than approximately 18 inches, which ensures that the ends of the tubes do not extend above the level of the liquid that accumulates in top tank 106. FIG. 4B and FIG. 4C also show barrier plate 130 inside of top tank 106.

Referring back to FIG. 4A, tube clamp assemblies 120/122 utilize clamp plates that face the interior of top tank 106 rather than the interior of wash chamber 108. Moreover, a center opening 131 may be formed from a conduit that is open on both ends and is approximately 18 inches long. If the liquid level in top tank 106 exceeds 18 inches in depth, the excess fluid drains directly through center opening 131 into wash chamber 108, preventing top tank 106 from overfilling and starving the associated source tank below. This conduit ordinarily rests against the top of the plate that is common to top tank 106 and wash chamber 108. After the wash/rinse cycle is complete, the conduit is lifted, which allows the liquid in top tank 106 to rapidly drain into wash chamber 108. This greatly facilitates the return of the solution to the respective source tank. FIG. 4C also shows the conduit forming center opening 131 and its positioning within top tank 106 relative to barrier plate 130.

The wash chamber 108 is loaded when in the horizontal position, with tower assembly 102 biased near the front of tube cleaning system 100 (see FIG. 3). Then, the tower assembly 102 is rotated to a vertical orientation such that the top tank 106 is above the wash chamber 108. Solutions or fluids (e.g., cleaning solution and rinse solution) are siphoned or pumped into the top tank 106 and the solution in the top tank 106 flows through and around the tubes, which are "hanging" in the wash chamber 108. The tubes can be clustered in a suitable manner that provides adequate spacing between neighboring tubes; this facilitates good fluid flow between the tubes and efficient cleaning of the external surfaces of the tubes. After the cleaning cycle is complete, the tower assembly 102 is returned to the horizontal position, which facilitates easy removal of the tubes. The horizontal loading and unloading of the wash chamber 108 makes the system 100 particularly suitable for cleaning long tubes (e.g., more than 8-10 feet long), which would otherwise be very difficult to load in a vertically-oriented wash chamber.

Figure 7:
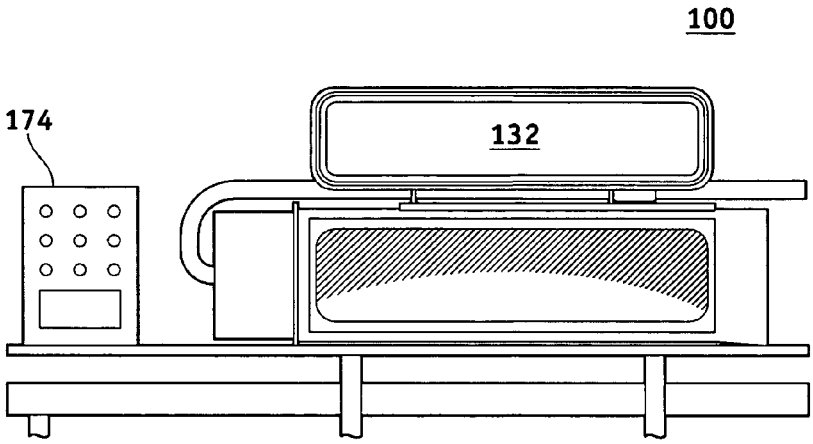
FIG. 7 is a front view of the tube cleaning system in a load/unload state.

The wash chamber 108 includes a movable chamber door 132 (see FIG. 2) connected to the wash chamber 108 by a hinge. FIG. 7 is a perspective view of the tube cleaning system 100 in a load/unload state with chamber door 132 open. In a preferred embodiment, the chamber door 132 is opened and closed by an actuator, such as a pneumatic cylinder, a hydraulic cylinder, or the like.

The top tank 106 has an inlet port 134 (see FIG. 1) configured to receive fluid. The holding plate 114 of the top tank 106 may also serve as a "divider" between the top tank 106 and the wash chamber 108; the holding plate 114 is suitably configured to hold the tubes and to enable solution to flow through the tubes and between the tubes. After the solution passes through and around the tubes, it is contained within the wash chamber 108. The wash chamber 108 has a drain port configured to carry fluid out of the wash chamber 108. The fluid is supplied to the top tank 106 by feed tube 110, which provides sufficient fluid flow to clean a tube or group of tubes.

In the example embodiment, tower assembly 102 "rides" on support platform 104 using a suitably configured tower positioner coupled to tower assembly 102 and to support platform 104. In practice, the tower positioner may be realized as a base plate, a frame, a rail, or other subsystem. In the horizontal orientation, the tower assembly 102 moves between a load/unload position on support platform 104 (shown in FIG. 3) and a safety position on support platform 104. In this context, the "safety position" refers to a position that is away from the operator 105, e.g., toward the back of the cell in which system 100 resides. When tower assembly 102 is in the safety position, chamber door 132 can be opened and closed without risk of injury to the operator 105.

In the vertical cleaning orientation, the tower assembly 102 "rides" on support platform 104 using a suitably configured receptacle selection mechanism coupled to tower assembly 102 and to support platform 104. This enables system 100 to move tower assembly 102 into alignment with a specified one of the solution receptacles 112 when tower assembly 102 is in the cleaning orientation. In practice, the receptacle selection mechanism may be realized as a base plate, a frame, a rail, or other subsystem. In this example embodiment, the receptacle selection mechanism and the tower positioner are coupled together, forming an integrated tower positioning mechanism for tower assembly 102. As described in more detail below, this integrated positioning mechanism may also facilitate rotation of tower assembly 102 between the load/unload orientation and the cleaning orientation.

Figure 8:
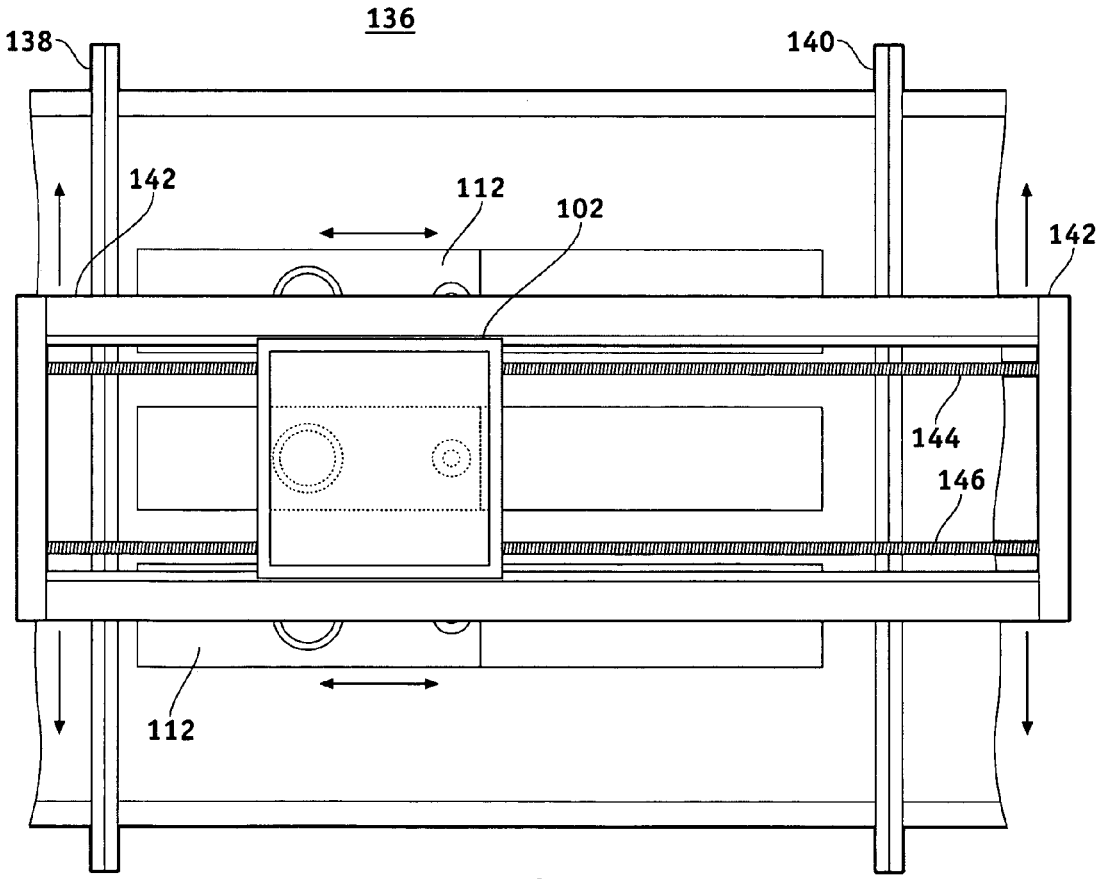
FIG. 8 is a schematic top view representation of the tube cleaning system.
Figure 9:
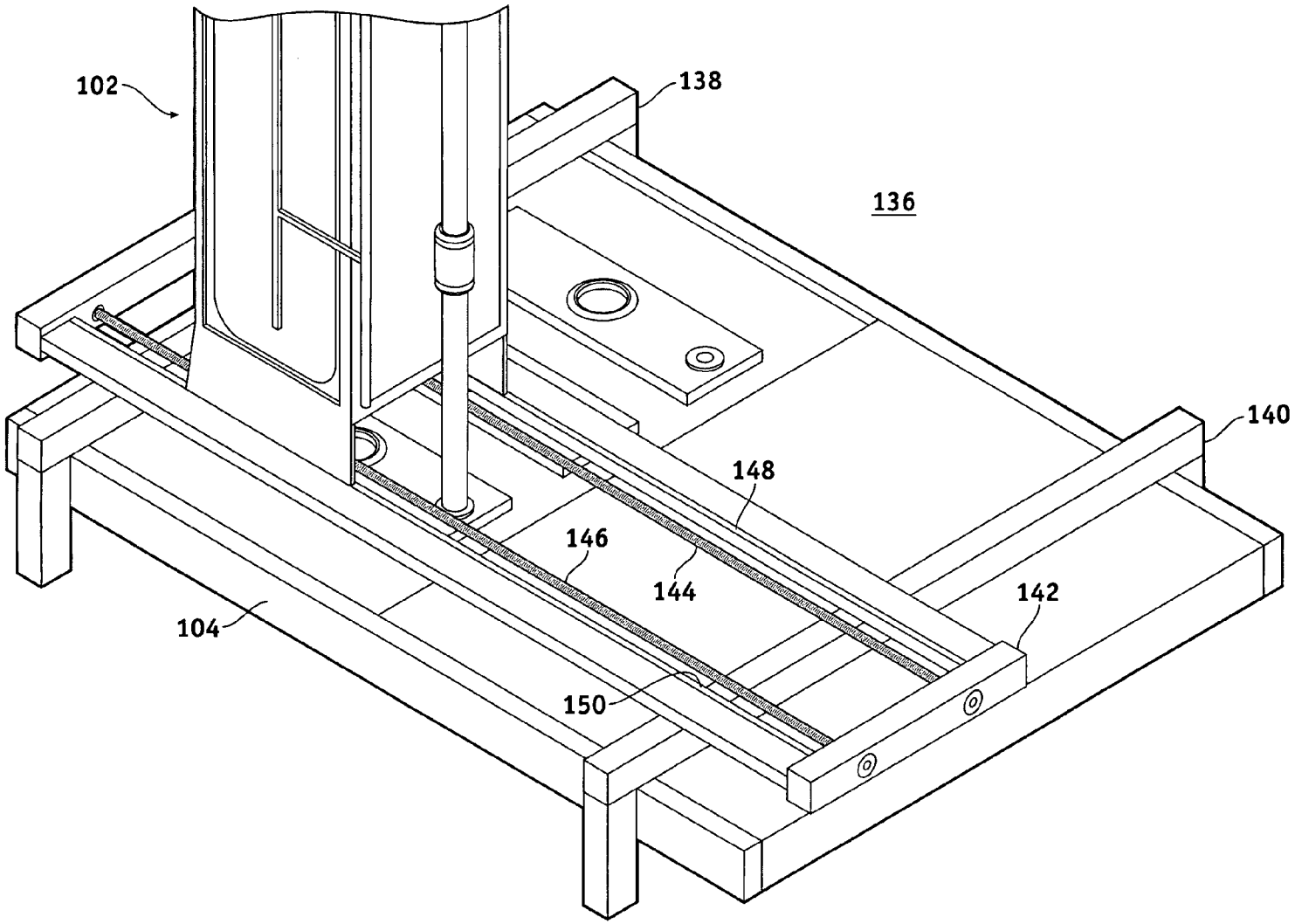
FIG. 9 is a perspective view of a portion of the tube cleaning system, showing the tower positioning mechanism.

A suitable tower positioning mechanism 136 is generally depicted in FIG. 8 and FIG. 9. FIG. 8 is a schematic top view representation of the tube cleaning system 100, and FIG. 9 is a perspective view of a portion of the tube cleaning system 100. As mentioned above, tower positioning mechanism 136 may utilize any number and/or combination of rails, a frame, support members, or the like, and FIG. 8 and FIG. 9 only depict one example embodiment. The top of FIG. 8 represents the back portion of the manufacturing cell, while the bottom of FIG. 8 represents the front portion of the cell (where the operator 105 stands). The right side of FIG. 9 represents the back portion of the cell, while the left side of FIG. 9 represents the front portion of the cell.

Tower positioning mechanism 136 generally includes a first transverse rail 138, a second transverse rail 140, a support frame 142, a first ball screw 144, a second ball screw 146, a first tower rotation guide element 148 (not shown in FIG. 8), and a second tower rotation guide element 150 (not shown in FIG. 8). Tower assembly 102 is supported by support frame 142, which is rectangular in shape. In the practical embodiment shown in FIG. 9, support frame 142 houses ball screws 144/146, a servo drive, roller guides, and other operating elements. Support frame 142 sits upon transverse rails 138/140, which allow tower assembly 102 to slide over solution receptacles 112 and into alignment with a designated solution receptacle as needed during the cleaning cycle. Manipulation of support frame 142 enables tower assembly 102 to move over solution receptacles 112 (whether tower assembly 102 is in the horizontal or vertical orientation).

In one practical embodiment, each of the transverse rails 138/140 includes a bearing way on its upper surface. These bearing ways enable support frame 142 to move laterally between the front and rear of the cell. Although not shown, a ball screw system (or other translation mechanism) may be attached to one or both of the transverse rails 138/140. This ball screw system can be engaged to move support frame 142 between the front and rear of the cell (the vertical arrows in FIG. 8 indicate the direction of this motion).

Figure 10:
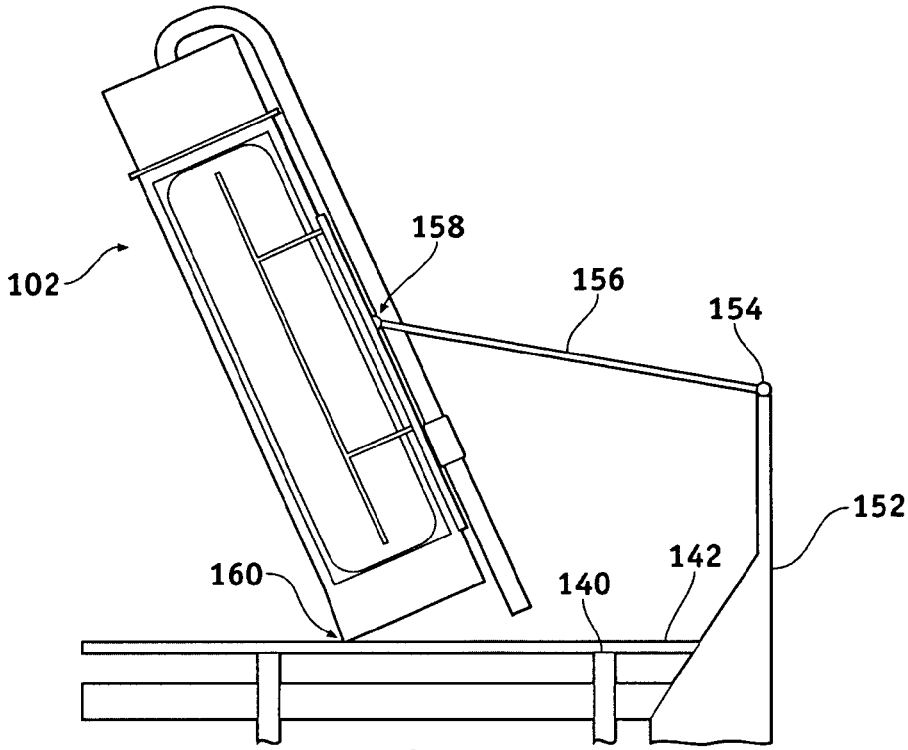
FIG. 10 is a front view of the tube cleaning system in the process of rotating the tower assembly.

Tower positioning mechanism 136 may also be configured to rotate tower assembly 102 between the horizontal load/unload orientation and the vertical cleaning orientation. In this regard, tower positioning mechanism 136 engages ball screws 144/146 to rotate tower assembly 102. FIG. 10 is a perspective view of the tube cleaning system 100 in the process of rotating the tower assembly 102. As shown in FIG. 10, system 100 may include an upright support 152 having a cross member 154 that spans the depth of support platform 104. A link member 156 is coupled between tower assembly 102 and cross member 154. In this example, link member 156 is U-shaped, and each "leg" is pivotally attached to a respective attachment point 158 on tower assembly 102. In other words, attachment points 158 are hinged. The "base" of link member 156 is pivotally coupled to cross member 154 via blocks or other structural elements. The blocks are coupled to cross member 154 via a suitably configured bearing rail or other sliding mechanism. Thus, link member 156 is hinged at cross member 154, and link member 156 can move with tower assembly between the front and rear of the cell. Tower assembly 102 may include rollers, wheels, or any suitable mechanism, that allows tower assembly 102 to slide along support frame 142 during rotation. In this example, the rollers are located at the base of tower assembly 102 near two of the corners. One roller location is identified by reference number 160 (the other roller location is obscured from view). In operation, tower assembly rotates about the points defined by the rollers, which travel within tower rotation guide elements 148/150 (not shown in FIG. 10).

The transverse edge of tower assembly 102 (which spans between the rollers) is coupled to ball screws 144/146 using two ball nuts housed in a hinged support beam. System 100 may utilize a suitable servo motor to rotate ball screws 144/146 (the two ball screws 144/146 may be coupled together using a chain and sprocket). Rotation of ball screws 144/146 cause the ball nuts to move along the ball screws 144/146, which in turn force the edge of tower assembly 102 to move along support frame 142 in the direction of the horizontal arrows in FIG. 8. In FIG. 8 and FIG. 10, movement of this edge from right to left causes tower assembly 102 to rotate from the horizontal orientation to the vertical orientation, and movement of this edge from left to right causes tower assembly 102 to rotate from the vertical orientation to the horizontal orientation. Rotation of tower assembly 102 is restricted by link member 156. Notably, the design of the linkage system allows tower assembly 102 to rotate using less space than a simple hinge system. In practice, the rotation footprint is contained entirely within the work cell. The rotating mechanism described herein represents one practical implementation suitable for use with system 100. The rotating mechanism is generally configured to rotate tower assembly 102 between the load/unload orientation and the cleaning orientation. Accordingly, alternative rotating mechanisms that achieve this functionality may be employed in practical embodiments of the invention.

As shown in FIG. 1 and FIG. 8, in the example embodiment, the system utilizes three separate solution receptacles 112 that contain a cleaning solution, a first rinse solution, and a final rinse solution, respectively. As mentioned above, tower positioning mechanism 136 moves the tower assembly 102 over solution receptacles 112 to enable system 100 to select the appropriate solution receptacle for the current stage in the cleaning cycle. Position sensors can be installed on transverse rails 138/140 to sense when the support frame 142, and thus the tower assembly 102, is aligned with one of the solution receptacles 112.

A drain port from the wash chamber 108 is located at the bottom of wash chamber 108 when tower assembly 102 is in the cleaning orientation. In the example embodiment, the drain port in wash chamber 108 remains open to achieve continuous draining. A drain coupler or drain foot may be extended from the drain port to ensure that the returning fluid effectively drains into the designated solution receptacle 112. A drain foot actuator provides the force to extend and retract the drain foot. The drain foot retracts in order to allow the wash chamber 108 to be moved from one solution receptacle 112 to another. In a preferred embodiment, the drain foot actuator is a pneumatic cylinder. However, in other embodiments, the drain foot actuator may include any suitable actuator, such as a hydraulic cylinder, or the like.

Each solution receptacle 112 includes a feed port and a return port; in FIG. 1 and FIG. 8, the feed ports are located near the center of system 100 and the return ports are located near the left side of system 100. In practice, the solution receptacles 112 may be placed in a secondary containment basin 160 (which is also supported by the support platform 104) to capture and contain any fluids that leak or spill from the solution receptacles 112, the top tank 106, or the wash chamber 108. Secondary containment basin 160 is depicted in FIG. 1. In a preferred embodiment, the solution receptacles 112 are constructed of welded polypropylene plastic, each has a capacity of approximately 200 gallons, and each includes a removable lid.

Referring to FIG. 1, the system 100 may utilize a waste pump 162, which is coupled to the initial rinse solution receptacle to pump the fluid from the initial rinse solution receptacle out to a waste system. Additionally, the system may utilize a transfer pump 164 coupled between the initial rinse solution receptacle and the final rinse solution receptacle. The transfer pump 164 can be used to transfer the final rise solution from the final rinse solution receptacle into the initial rinse solution receptacle (this allows "recycling" of "dirty" final rinse solution, which may be suitable for use as the initial rinse solution even though it is no longer suitable for use as a final rinse solution). In a preferred embodiment of the invention, the waste pump 162 and the transfer pump 164 are diaphragm-type pumps, which are able to function with high concentrations of contaminants in the rinse fluids. However, in other embodiments, the waste pump 162 or the transfer pump 164 may include any suitable pump for transferring the initial rinse fluid or the final rinse fluid, such as a screw-type or progressive cavity pump, a gear pump, a centrifugal pump, or the like.

In addition, an alternative embodiment includes a clean water pump 166 coupled to the final rinse solution receptacle to replenish the final rinse fluid with clean water. The clean water pump 166 in an embodiment is a centrifugal pump, although other embodiments may include any suitable pump, such as a diaphragm pump, a gear pump, a screw-type pump, or the like. Nevertheless, some preferred embodiments do not include a clean water pump 166, but rather require a suitable external clean water supply. Thus, periodically, the final rinse fluid is replaced, partially replaced or replenished with clean water, and the previous final rinse fluid is then used to replenish the first rinse fluid, while at least part of the previous first rinse fluid is discharged to waste. In this way, the rinse fluids in the two rinse solution receptacles are periodically refreshed.

The aqueous tube cleaning system 100 may also include a supply pump 168 coupled to the feed tube 110 to pump fluid from one of the three solution receptacles into the top tank 106. In one example embodiment, a supply conduit coupler 170 is connected at an inlet end of the feed tube 110, and may be configured to create a sealed connection with the currently adjacent solution receptacle.

The supply pump 168 may include a supply pump drain valve with a supply pump drain valve actuator to drain fluid, such as water or cleaning solution, from the supply pump 168. The supply pump drain valve is opened before the supply pump priming cycle to clear most of the previous solution from the supply pump 168. A shut-off valve and a shut-off valve actuator can be installed on the outlet side of the supply pump 168. This shut-off valve is closed after the fluid has been drained from the supply pump 168 in order to allow the supply pump 168 to be primed. A vacuum chamber is coupled to the supply pump 168 with a vacuum valve and a vacuum valve actuator. When the shut-off valve and the supply pump drain valve are closed and the vacuum valve is opened, the vacuum in the vacuum chamber draws fluid through the inlet end of the feed tube 110 from one of the solution receptacles into the supply pump 168 to prime the supply pump 168. Although the supply pump 168 used in this embodiment is a self-priming pump that requires a continuous liquid connection between the source receptacle and the pump body to initiate fluid flow, other embodiments may include any suitable pump, including a dry-priming pump that would not require the same priming system configuration.

A heating element and a temperature sensor may be installed in the cleaning solution receptacle to heat and sense the temperature of the cleaning solution fluid. Likewise, a heating element and a temperature sensor may be installed in the initial rinse solution receptacle, and another heating element and another temperature sensor may be installed in the final rinse solution receptacle to heat and sense the temperatures of the initial rinse fluid and the final rinse fluid.

In addition, the aqueous tube cleaning system 100 may include a suitably configured controller 172 and an operator input device 174 to provide control for the electrical components of the tube cleaning system 100. FIG. 1 depicts these elements schematically, and FIG. 11 (which is a perspective view of a manufacturing cell for the tube cleaning system 100) shows a typical location for an operator input device 174 or panel. In practice, controller 172 may be housed behind the panel shown in FIG. 11. The operator input device 174 or panel is also shown in FIG. 7.

An example of a controller 172 that is compatible with the aqueous tube cleaning system 100 is an Allen-Bradley Micrologics 1500 programmable logic controller, manufactured by Rockwell Automation, Inc., of Wisconsin, U.S.A. The controller 172 is coupled to the drive system in order to control the movement and position of the tower assembly 102, and thus the wash chamber 108 and the top tank 106. The controller 172 receives position signals from the position sensors to signal the controller 172 when the tower assembly 102 is aligned with one of the solution receptacles 112, that is, the cleaning solution receptacle, the initial rinse solution receptacle, or the final rinse solution receptacle.

The controller 172 may also be coupled to the supply pump 168, the supply pump drain valve actuator, the shut-off valve actuator, and the vacuum valve actuator to control the supply pump 168 and the supply pump priming system. After each clean or rinse cycle is completed, the controller 172 sends a control signal to the supply pump drain valve actuator to open the supply pump drain valve, allowing fluid to drain from the supply pump 168. Then the controller 172 commands the supply pump drain valve actuator to close the supply pump drain valve, and commands the shut-off valve actuator to close the shut-off valve. With the supply pump drain valve and the shut-off valve closed, the controller 172 commands the vacuum valve actuator to command the vacuum valve to open, providing vacuum to the supply pump 168 in order to draw fluid through the inlet side of the feed tube 110 and through the supply pump 168.

The controller 172 may also be coupled to the three heating elements and to the three temperature sensors. The controller 172 receives temperature signals from the temperature sensors, and in response individually controls the heating elements in order to maintain the fluid temperature in each of the solution receptacles 112 within a specified range, as required for the cleaning application. For example, in a preferred embodiment the fluid temperature in each of the solution receptacles 112 is maintained between 130° F. and 140° F. Additionally, in a preferred embodiment, the controller 172 is configured to alert an over-temperature condition in the cleaning solution receptacle, the initial rinse solution receptacle, or the final rinse solution receptacle when the temperature signal received from one of the temperature sensors is greater than 70° C. (158° F.). Likewise, level sensors can be installed in the solution receptacles 112 to sense the levels of fluid in each receptacle. For example in a preferred embodiment, a four-position float switch in each of the solution receptacles 112 senses a fluid rise of 2.7 inches (empty), a fluid rise of 7 inches (heater immersed), a fluid rise of 13 inches (refresh level), and a fluid rise of 15 inches (full).

In a preferred embodiment, the controller 172 is further coupled to the waste pump 162, the transfer pump 164, and the clean water pump 166. In this embodiment, the controller 172 is configured to automatically refresh the first and second rinse fluids at specified times on specified days. Alternative embodiments refresh the first and second rinse fluids according to other schedules, for example, after a predetermined number of cycles or after a predetermined amount of time. Moreover, in a preferred embodiment, a position sensor provides a position signal representing the position of the drain foot to the controller 172, and the controller 172 does not command the drive system to move the tower assembly 102 unless the drain foot is in the retracted position.

The user input device 174 is coupled to the controller 172 to provide control inputs to the controller 172. For example, in a preferred embodiment of the invention, the input device 174 includes a CYCLE START button to initiate a clean and rinse cycle, a CYCLE STOP button to halt to end a clean and rinse cycle, an E-STOP button to halt operation of the tube cleaning system 100 in an emergency, and an E-STOP RESET button to allow the tube cleaning system 100 to return to normal operation after an emergency stop. However, other embodiments of the invention include any suitable inputs required to provide additional desired control functions. One example input device 174 is an electromechanical push-button type switch control panel. However, other embodiments may include any type of input device, including a digital pad, a keypad, touch screen, audio recognition system, or the like. Furthermore, the input device 174 may include a visual display device in order to provide additional output to an operator. As an example of an input device that is compatible with the aqueous tube cleaning system 100, a preferred embodiment includes an Allen-Bradley Panelview 300 Micro digital pad with display.

As mentioned above in connection with FIGS. 4-6, a holding plate 114 may be located between the top tank 106 and the wash chamber 108; the holding plate 114 is suitably configured to provide fluid communication between the top tank 106 and the wash chamber 108. In one practical embodiment, a tube, or a group or bundle of tubes, is placed so that it extends through the holding plate 114 and into the top tank 106, and then a tube clamp assembly is engaged to hold the tube or tube bundle in place. For example, in one embodiment, tubes typically are bundled into groups of 7-9 tubes. In practice, the tube clamp assembly holds the tube or bundle of tubes in place and substantially closes the space surrounding the tubes to inhibit excess fluid flow through the holding plate 114 and into the wash chamber 108.

The feed tube 110 for the cleaning/rinse solutions is coupled to one of the solution receptacles by the supply conduit coupler 170. The force to extend or retract the supply conduit coupler 170 is provided by a supply coupler actuator. For example, in a preferred embodiment the supply coupler actuator includes a pneumatic cylinder. However, in other embodiments, the supply coupler actuator may be any suitable actuator, for example, a hydraulic cylinder, a torque motor, or the like. In addition, a position sensor senses the position of the supply conduit coupler 170 and sends a representative signal to the controller 172. Thus, the controller 172 does not command the drive system to move the tower assembly 102 unless the supply conduit coupler 170 is in the retracted position.

In operation, the aqueous tube cleaning system 100 is configured to automatically perform a complete clean and rinse cycle. The tube or bundle of tubes is installed in the wash chamber 108 by the operator 105. The operator 105 then pushes the CYCLE START push button on the input device 174, signaling the tube clamp assemblies to close, and signaling the wash chamber door actuator to actuate the chamber door 132 to the closed position.

In the example embodiment, the solution heating elements maintain the solutions at a designated temperature. In other words, the heating elements continuously warm the cleaning solution fluid in the cleaning solution receptacle, the initial rinse solution in the initial rinse solution receptacle, and the final rinse solution in the final rinse solution receptacle. The controller 172 receives temperature signals from the temperature sensors indicating the temperature of the cleaning solution fluid, the initial rinse fluid and the final rinse fluid, respectively. The controller 172 can monitor the temperature signals from temperature sensors continuously during the wash and rinse cycle to maintain the temperatures of the cleaning solution fluid, the initial rinse fluid and the final rinse fluid with a predetermined range, for example, between 130° F. and 140° F. In practice, the controller 172 may disable the heating element for the solution receptacle 112 that is currently in use. When in use, the receptacle liquid levels are relatively low since fluid has been pumped into top tank 106. The disabling of the heating element is a precautionary measure that avoids overheating of the heating element if the heating element is exposed to air (which may occur at low solution levels).

After verifying that the cleaning solution temperature is within the prescribed range, the controller 172 commands the system 100 to move tower assembly 102 from the load/unload position to the safety position at the back of the cell. At this time, tower assembly 102 is still in the horizontal orientation. Once in the safety position, controller 172 signals the system 100 to close the chamber door 132. After closing the chamber door 132, the controller 172 governs the rotation of the tower assembly 102 from the horizontal orientation to the vertical cleaning orientation. In the preferred embodiment, once tower assembly 102 has rotated into the vertical cleaning orientation, it becomes aligned with the cleaning solution receptacle. The controller 172 then actuates the drain foot and the supply conduit coupler 170 to their extended positions to ensure proper drainage and to ensure that the feed tube 110 is sealed to the cleaning solution receptacle. The controller 172 then closes a shut-off valve (not shown) and opens the vacuum valve to draw fluid into the supply pump 168 to prime the pump. The controller 172 then closes the vacuum valve, starts the supply pump 168 and opens the shut-off valve to provide cleaning solution fluid to the top tank 106.

As the cleaning solution fluid level in the top tank 106 rises to the top of the overflow conduit 131 and stays at that level, it delivers the cleaning solution steadily through and around the tubes under a maintained constant fluid pressure (the in-flow of fluid is faster than the outflow, which creates an overflow situation such that the fluid level is maintained at the height of the conduit 131). In this regard, the pressure at the bottom of the top tank 106 increases as fluid rises and the cleaning solution fluid is forced by the pressure created by gravity through and around the tube or bundle of tubes into the wash chamber 108. Top tank 106 holds and delivers the solution to wash chamber 108 in this passive manner. Thus, top tank 106 and wash chamber 108 are suitably configured to dispense fluid to clean the tubes. The system 100 maintains a flow of cleaning fluid in this manner for a predetermined period of time, during which the cleaning fluid exits the wash chamber 108 and returns to the cleaning solution receptacle. The cleaning solution fluid flows both through the tube or bundle of tubes and around the tube or bundle of tubes in order to clean the inner surface as well as the outer surface of the tube or bundle of tubes. Of course, the specific wash and rinse time periods may be adjusted by way of the operator interface input device 174.

When the clean cycle is finished, the controller 172 commands the supply pump 168 off and opens the supply pump drain valve so the cleaning solution fluid will drain from the supply pump. The conduit 131 is raised by two actuators to allow quick emptying of cleaning fluid from top tank 106 into wash chamber 108. In addition, the fluid will continue to drain from the drain foot of the wash chamber 108. This process has the advantage that cross-contamination between the solution tanks 112 is minimized, thereby maximizing the useful life of the first and final rinse solutions. The controller 172 then commands the drain foot and the supply conduit coupler 170 to their respective retracted positions, and commands the drive system to move the vertically-oriented tower assembly 102 into alignment with the first rinse tank.

As before, the controller 172 commands the coupler 170 and the drain foot to their respective extended positions for the initial rinse solution receptacle. The controller 172 closes the supply pump drain valve and the shut-off valve, and then opens the vacuum valve to draw the first rinse fluid into the supply pump 168 to prime the supply pump 168. The controller 172 then commands the shut-off valve open and the vacuum valve closed, and starts the supply pump 168. The initial rinse fluid is pumped through the feed tube 110 into the top tank 106, and as the initial rinse fluid rises, the pressure created by gravity forces the initial rinse fluid through and around the tube or bundle of tubes into the wash chamber 108.

The first rinse cycle is allowed to continue for a predetermined period—for example, two minutes—and then the controller 172 commands the supply pump 168 off and the supply pump drain valve open. The overflow conduit 131 is then raised to allow quick emptying of the first rinse fluid from top tank 106 down to wash chamber 108 and back into the first rinse receptacle. During the rinsing period the first rinse fluid continues to drain from the wash chamber 108 back into the first rinse fluid receptacle. The controller 172 then re-closes the supply pump drain valve, and commands the supply coupler 170 and the drain foot into their respective retracted positions. Then the controller 172 commands the drive system to move the vertically-oriented tower assembly 102 into alignment with the final rinse solution receptacle.

At the final rinse solution receptacle, the controller 172 commands the coupler 170 and the drain foot into their respective extended positions for the final rinse solution receptacle. The controller 172 then commands the shut-off valve closed and the vacuum valve open to prime the supply pump 168. The controller 172 then closes the vacuum valve, opens the shut-off valve and starts the supply pump 168 to provide final rinse fluid to the top tank 106 through the supply conduit 110. As the final rinse fluid rises in the top tank 106, the final rinse fluid is forced by the pressure created by gravity through and around the tube or bundle of tubes into the wash chamber 108.

The controller 172 allows the final rinse cycle to continue for a predetermined period—for example, two minutes—and then commands the supply pump 168 off. During the final rinse, the controller 172 opens the supply pump drain valve to allow the final rinse fluid to drain from the supply pump 168. In addition, the overflow conduit 131 is raised to allow quick emptying of final rinse fluid from top tank 106 down to wash chamber 108 and back into the final rinse receptacle. Moreover, the final rinse fluid continues to drain from wash chamber 108 for return to the final rinse solution receptacle. Thereafter, the controller 172 re-closes the supply pump drain valve. The controller 172 then commands the coupler 170 and the drain foot into their respective retracted positions to end the final rinse cycle. In addition, the controller 172 causes the tower assembly 102 to return to the horizontal position. At this point, one complete clean and rinse cycle has been completed and the controller 172 commands the wash chamber lid actuator to actuate the chamber door 132 to the open position. Thereafter, the tower assembly 102 is moved back into the load/unload position, which enables easy unloading of the tubes by the operator 105. In this regard, the operator 105 may manipulate switches or other control elements to unclamp the tubes.

Operation of an Example Embodiment

Figure 11:
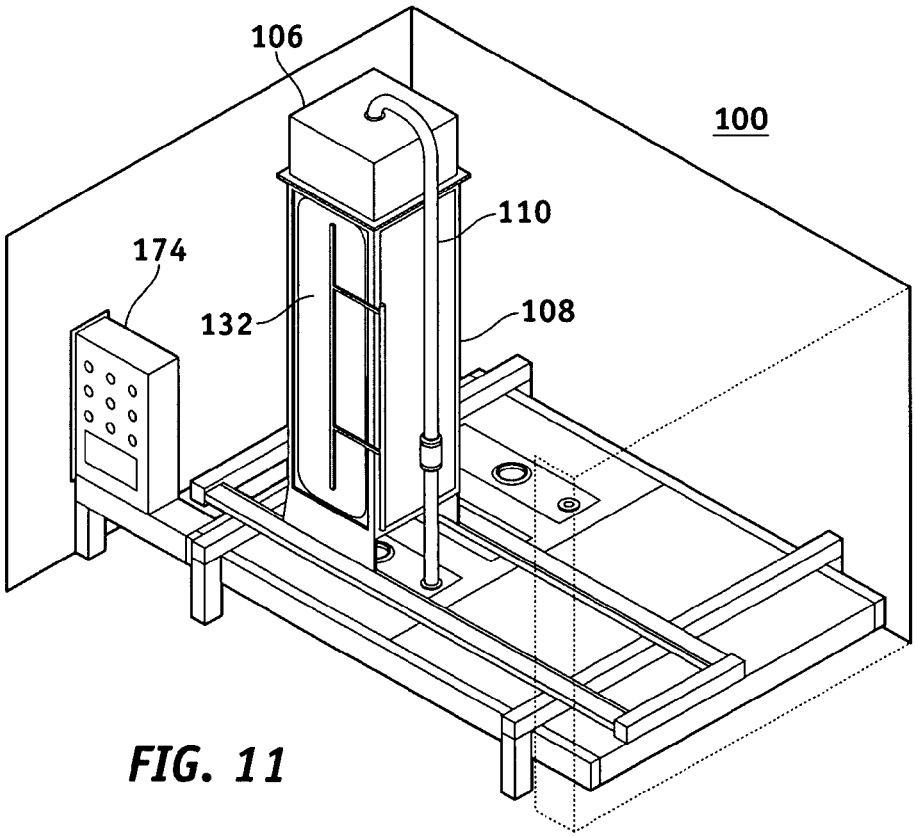
FIG. 11 is a perspective view of a manufacturing cell for the tube cleaning system.

A tube cleaning system 100 configured in accordance with an example embodiment of the invention includes three solution receptacles 112 and a movable/tilting tower assembly 102. FIG. 11 shows an example cleaning system 100 with the tower assembly 102 in the vertical position. The cleaning system 100 is an aqueous tube washing system utilizing a water-based cleaner. There is one solution receptacle containing the cleaning solution, and two rinse tanks, each containing clean rinse water (or any suitable rinse solution). The tower assembly 102 includes a top tank 106, a supply pump 168, a feed tube 110, and a wash chamber 108. The wash chamber door 132 is opened when the tower assembly 102 is in the horizontal position, allowing an operator 105 to load or unload parts. In this horizontal position, the tower assembly is positioned toward the front of the system 100 and close to the operator 105 (see FIG. 3). Multiple bundles of tubes up to 12 feet long may be cleaned in the example embodiment, including tubes of different diameters, tubes of different lengths, and tubes having different bend shapes. Bundles of tubes are placed inside the wash chamber 108 as described above. The ends of the tube bundles are inserted into the top tank 106 and held in place with sliding tube clamp assemblies. Cleaning solution/rinse water is delivered to the top tank 106 via the feed tube 110. The cleaning solution then drains via gravity through the tube bundles. The tube clamp assemblies allow the ends of a wide variety of tubes to be located so that one end of the tubes is held securely inside of the top tank 106. Once secured, the feed tube 110 will supply cleaning solution/rinse water to the tower assembly 102 via the top tank 106. When the liquid level rises in the top tank 106, the liquid is forced through and around the tubes. No individual fluid connections to the tube(s) are required. Once the tubes are clamped inside the wash chamber 108, the operator 105 pushes the start button and the cleaning process begins. The wash chamber 108 moves to the safety position in order to safely close the chamber door 132 and rotate the tower assembly 102 to the vertical washing/rinsing position.

For operator safety, the tower assembly 102 moves to the back of the cell before the wash chamber door 132 is closed. Thereafter, the system 100 rotates the tower assembly 102 to the vertical wash/rinse position. The cell is enclosed on three sides and protected in front by a light curtain (not shown). If an operator 105 attempts to enter the cell once the wash cycle has started, the system 100 immediately stops all motion and pauses the cleaning cycle. Once the wash chamber door 132 is closed, the tower assembly 102 rotates to the vertical position.

Once the tower assembly 102 is rotated to the vertical position, the tower assembly 102 is connected to the cleaning solution receptacle positioned directly underneath. The connections are made via a siphon foot and drain foot which are located on the tower assembly 102. The siphon foot and drain foot are extended downward until they contact the top of the cleaning solution receptacle, forming a watertight seal against the receptacle. In the example embodiment, a 500 gallon per minute pump 168 is primed (liquid is drawn up into the pump from the receptacle via a vacuum priming system). Once the pump 168 is primed, it is activated and pumps liquid from the cleaning solution receptacle up to the top tank 106. The top tank 106 fills with liquid which then drains through and around the tube bundles, cleaning them very effectively. Once a predetermined wash time has elapsed, the pump 168 is turned off and the top tank 106 is allowed to drain for a predetermined amount of time, which can be set by the operator 105. Optionally, the tower assembly 102 may be rotated back to its horizontal position for allow for additional draining to ensure that any solution accumulated on the tubes is adequately drained. The drain and siphon feet are retracted after the designated draining time has elapsed, and the entire tower assembly 102 moves to the initial rinse solution receptacle. The drain and siphon feet extend, making water-tight contact with the top of the initial rinse solution receptacle. The pump 168 is then primed as above and the tubes are flooded with water from the initial rinse solution receptacle.

After the tubes have been flooded for a specified time interval, the pump 168 stops and the tubes are allowed to drain for a designated time period. Once that predetermined draining period has elapsed, the siphon and drain feet are retracted and the tower assembly 102 moves to the final rinse solution receptacle where the process is repeated, completing the wash-rinse sequence. Once the final rinse cycle is complete and the tower assembly 102 has drained, it moves to the back of the cell. The tower assembly 102 then rotates to the horizontal position and the wash chamber door 132 opens. After the tower assembly 102 is horizontal and the door 132 is open, the tower assembly 102 moves to the front of the cell. Once the tower assembly 102 has moved to the front of the cell, the operator 105 can then unload the tube bundles and begin the process again.

A more detailed operating procedure for the tube cleaning system 100 will now be described. Part loading is performed in the following manner. First, the operator 105 positions bundle(s) of tubes through the holding plate 114 (see FIG. 4A and FIGS. 8-10) and activates tube holding/flow restriction system clamps located on the side of the control enclosure. Tube bundles may be secured using rubber bands, bungee cords, and/or any suitable strapping mechanism, and multiple bundles can be grouped together using bungee cords to simplify loading. As described above, one end of tube bundle(s) is manipulated through the holding plate 114 with fittings inside the clamping plates to prevent tubes from slipping out during the wash cycle. In practice, heavier tubes should be loaded through the lower tube clamp assembly 120 (see FIG. 4A), and longer tubes should be loaded through the rear tube clamp assembly 118. Multiple bundles of tubes can be positioned through the four tube clamp assemblies as part geometry allows. The operator should verify that all tube bundles are secured in the clamps and will not fall out during the wash cycle.

Figure 12:
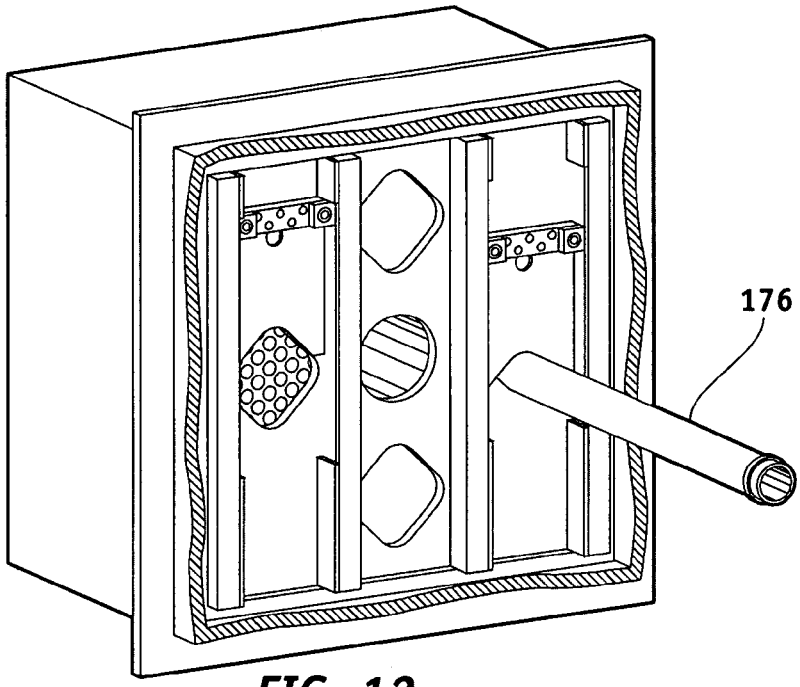
FIG. 12 is a perspective view of the interior of the wash chamber, showing a bypass tube installed in a tube clamp assembly.
Figure 13:
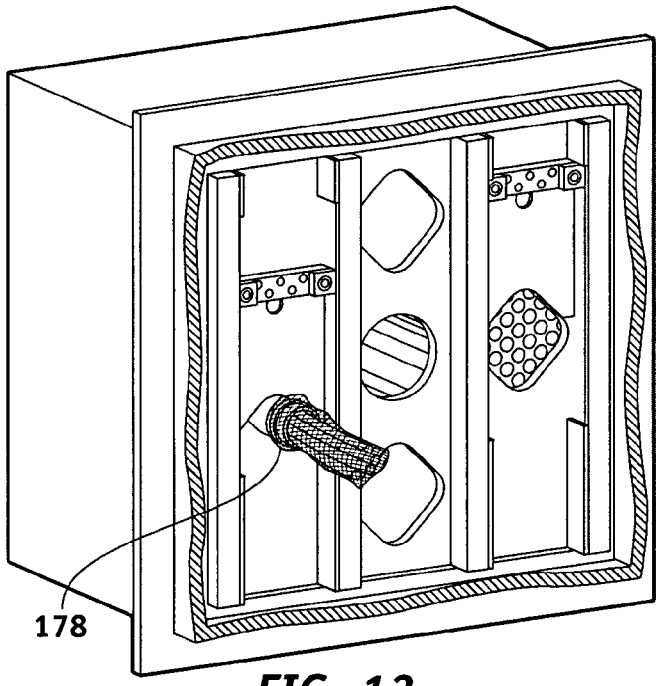
FIG. 13 is a perspective view of the interior of the wash chamber, showing containment of short tubes in a mesh bag.
Figure 14:
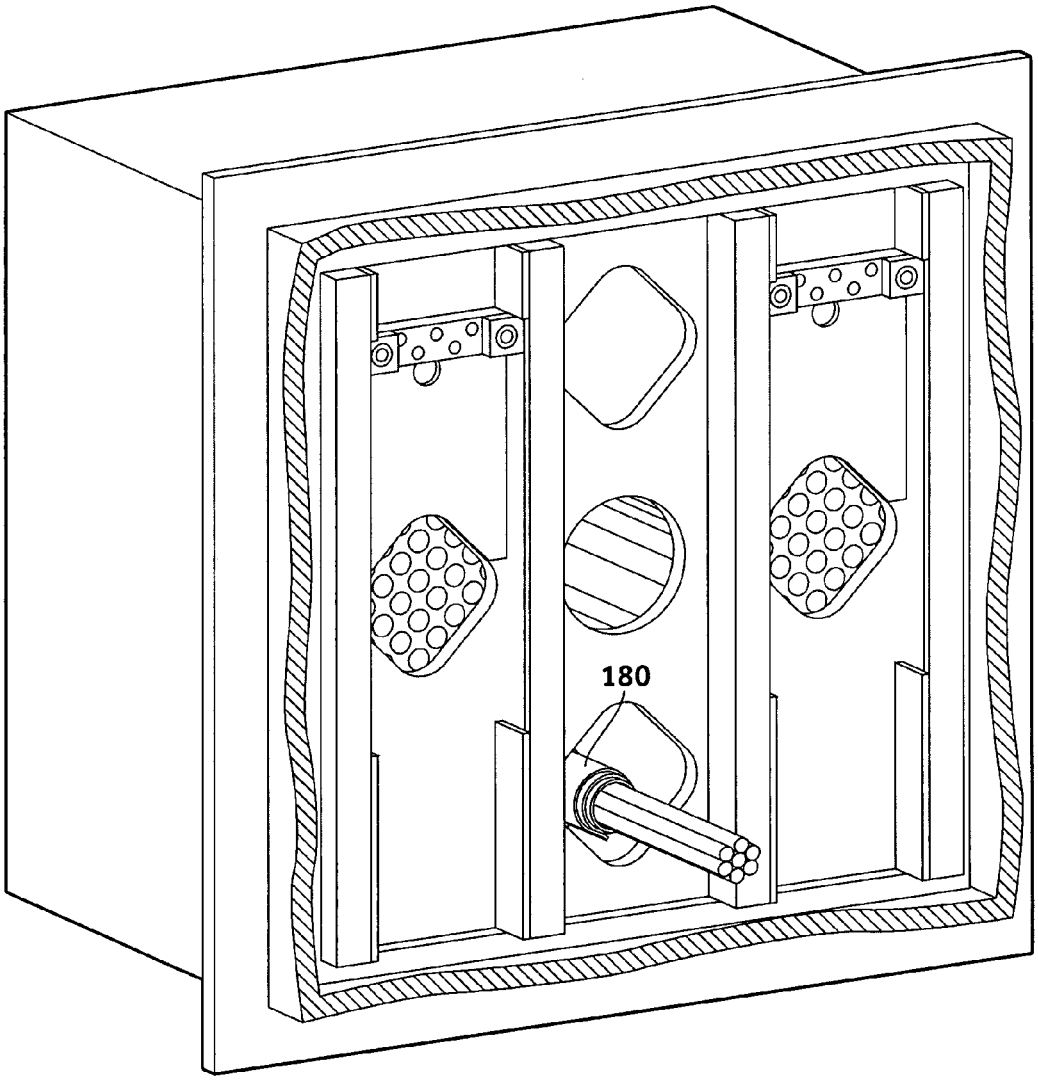
FIG. 14 is a perspective view of the interior of the wash chamber, showing a tube bundle surrounded by a protective wrap.

Referring to FIG. 12, if the part load mix does not allow all tube clamp assemblies to be utilized, the operator can insert a bypass tube 176 into an unused tube clamp assembly. This ensures that fluid will not overflow the top tank 106. To avoid a pinch hazard, parts shorter than six inches should be placed in a mesh nylon bag 178 securely attached to a bypass tube, which is then positioned in a tube clamp assembly (see FIG. 13). Neoprene or other suitable protective wrap 180 should be used around "O" condition aluminum tubing or aluminum tubes greater than 1.0 inch diameter and wall thickness 0.035 inch or less. The protective wrap can be positioned locally around the tube bundle in the tube clamp assembly, as shown in FIG. 14.

Basic machine operation is performed in the following manner. First, the operator 105 verifies that the load is securely clamped and that no other loose material is left inside the wash chamber 108. Using the user interface, the operator 105 can follow the displayed prompts. The operator 105 is prompted to acknowledge and clear the light curtain, and to press "cycle start" on the side of the control cabinet. In response to the "cycle start" command, the system 100 runs the programmed control cycle. The example cleaning cycle sequence is as follows: (1) tower assembly 102 moves to the safety position and the chamber door 132 closes; (2) tower assembly 102 rotates to the vertical cleaning orientation; (3) the siphon and drain feet extend toward the designated solution receptacle; (4) pump priming system initiates; (5) pump 168 starts drawing from the designated solution receptacle, filling the top tank 106 with solution that returns to the designated solution receptacle via the drain foot (re-circulates solution for programmed time); (6) the preprogrammed drain period begins immediately after pumping stops; (7) tower assembly 102 shuttles for alignment with the initial rinse solution receptacle; (8) steps 3-6 repeat (the initial rinse solution re-circulates for programmed time); (9) tower assembly 102 shuttles to the final rinse solution receptacle; (10) steps 3-6 repeat (the final rinse solution re-circulates for programmed time); (11) tower assembly 102 moves to the back of the cell; (12) tower assembly 102 rotates to the horizontal safety position; (13) wash chamber door 132 opens; (14) tower assembly 102 moves forward to the load/unload position; (15) wash cycle complete.

Thereafter, the operator 105 will support tube bundles by hand, open the clamp assemblies, and remove parts from wash chamber 108 to facilitating additional draining of tubes as required. The tube bundles may be placed in a drying cabinet (an optional step that depends upon the type of tubes being cleaned), and the operator 105 may use an air nozzle to blow dry parts as needed. For example, aluminum tubes have very low heat capacity and cool too quickly to effectively dry the tubes without the assistance of a dryer. Other materials such as stainless steel, for example, generally air dry without the need for a dryer. Other factors such as flow time may also be considered. In this regard, the tubes may not be allowed to rest long enough to accommodate air drying.

While at least one example embodiment has been presented in the foregoing detailed description, it should be appreciated that a vast number of variations exist. It should also be appreciated that the example embodiment or embodiments described herein are not intended to limit the scope, applicability, or configuration of the invention in any way. Rather, the foregoing detailed description will provide those skilled in the art with a convenient road map for implementing the described embodiment or embodiments. It should be understood that various changes can be made in the function and arrangement of elements without departing from the scope of the invention as set forth in the appended claims and the legal equivalents thereof.

What is claimed is:

1. A tube cleaning system comprising:

a support platform;

a tower assembly supported by said support platform, said tower assembly comprising a wash chamber;

a tube clamp assembly for holding a number of tubes in the wash chamber; and a rotating mechanism coupled to said tower assembly for rotating said tower assembly between a load/unload orientation and a cleaning orientation.

2. A tube cleaning system according to claim 1, said tower assembly further comprising a top tank coupled to said wash chamber, said top tank being configured to hold a solution and to deliver said solution to said wash chamber when said tower assembly is in said cleaning orientation.

3. A tube cleaning system according to claim 2, wherein pressure due to gravity forces said solution from said top tank to said wash chamber when said tower assembly is in said cleaning orientation.

4. A tube cleaning system according to claim 2, further comprising:

a solution receptacle coupled to said support platform;

a feed tube coupled to said top tank; and a pump configured to pump said solution from said solution receptacle to said top tank via said feed tube.

5. A tube cleaning system according to claim 4, further comprising retractable drain and siphon feet for making a fluid connection said solution receptacle.

6. A tube cleaning system according to claim 1, further comprising a tower positioner coupled to said tower assembly and to said support platform, said tower positioner being configured to move said tower assembly between a load/unload position on said support platform and a safety position on said support platform.

7. The system of claim 2, wherein the tube clamp assembly includes a clamp plate having an opening that is adjustable to receive tubes of different sizes.

8. The system of claim 7, wherein the clamp plate slides on rails to adjust size of the opening.

9. The system of claim 7, wherein the tube clamp assembly further includes a perforated barrier plate to prevent the tubes from being inserted farther than a specified distance.

10. A tube cleaning system according to claim 1, wherein:

said load/unload orientation is horizontal; and said cleaning orientation is vertical.

11. A tube cleaning system comprising:

a support platform;

a plurality of solution receptacles coupled to said support platform;

a tower assembly supported by said support platform; and a rotating mechanism coupled to said tower assembly, said rotating mechanism being configured to rotate said tower assembly between a load/unload orientation and a cleaning orientation;

said tower assembly comprising a top tank, a wash chamber coupled to said top tank, and a tube clamp assembly for holding a number of tubes in the wash chamber, said top tank being configured to hold a solution and to deliver said solution to said wash chamber to clean the tubes when said tower assembly is in said cleaning orientation.

12. A tube cleaning system according to claim 11, wherein pressure due to gravity forces said solution from said top tank to said wash chamber when said tower assembly is in said cleaning orientation.

13. A tube cleaning system according to claim 11, further comprising a tower positioner coupled to said tower assembly and to said support platform, said tower positioner being configured to move said tower assembly between a load/unload position on said support platform and a safety position on said support platform.

14. A tube cleaning system according to claim 11, said wash chamber comprising a drain foot configured to return solution to a specified one of said plurality of solution receptacles.

15. A tube cleaning system according to claim 11, further comprising:

a feed tube coupled to said top tank; and a pump configured to pump said solution from a specified one of said plurality of solution receptacles to said top tank via said feed tube.

16. A tube cleaning system according to claim 11, said plurality of solution receptacles comprising:

a cleaning solution receptacle for a tube cleaning solution; and a rinse solution receptacle for a tube rinsing solution.

17. A tube cleaning system according to claim 11, said plurality of solution receptacles comprising:

a cleaning solution receptacle for a tube cleaning solution;

an initial rinse solution receptacle for an initial tube rinsing solution; and a final rinse solution receptacle for a final tube rinsing solution.

18. A tube cleaning comprising:

a support platform;

a plurality of solution receptacles coupled to said support platform;

a tower assembly supported by said support platform; and a receptacle selection mechanism coupled to said tower assembly and to said support platform, said receptacle selection mechanism being configured to move said tower assembly into alignment with a specified one of said plurality of solution receptacles when said tower assembly is in said cleaning orientation;

a rotating mechanism coupled to said tower assembly for rotating said tower assembly between a load/unload orientation and a cleaning orientation;

said tower assembly comprising a top tank and a wash chamber coupled to said top tank, said top tank being configured to hold a solution and to deliver said solution to said wash chamber when said tower assembly is in said cleaning orientation; and said wash chamber being configured to hold a number of tubes and to dispense said solution to clean said number of tubes.

* * * * *